US005103842A

United States Patent [19]

Strang et al.

[11] Patent Number: 5,103,842

[45] Date of Patent: Apr. 14, 1992

[54] CONDITIONING CYLINDER WITH FLIGHTS, BACKMIXING BAFFLES, CONDITIONING NOZZLES AND AIR RECIRCULATION

[75] Inventors: John C. Strang; Steven G. Muller, both of Midlothian, Va.

[73] Assignee: Philip Morris Incorporated, New York, N.Y.

[21] Appl. No.: 567,020

[22] Filed: Aug. 14, 1990

[51] Int. Cl.[5] ..... A24B 3/04

[52] U.S. Cl. ..... 131/303; 131/305

[58] Field of Search ..... 131/305, 303; 34/134, 34/135, 139, 50

[56] References Cited

U.S. PATENT DOCUMENTS

| | | | |
|---|---|---|---|
| 2,924,513 | 2/1960 | Altimier et al. | 34/135 |
| 3,386,448 | 6/1968 | Wocknowski | 131/303 |
| 3,713,633 | 1/1973 | Falk et al. | 34/135 |
| 3,824,704 | 7/1974 | Neville . | |
| 3,851,404 | 12/1974 | Fracke et al. . | |
| 3,866,335 | 2/1975 | Neville . | |
| 3,906,961 | 9/1975 | Rowell et al. . | |
| 3,978,868 | 9/1976 | Thiele et al. | 131/303 |
| 4,054,145 | 10/1977 | Berndt et al. . | |
| 4,186,755 | 2/1980 | Schmidt | 131/303 |
| 4,202,357 | 5/1980 | de al Burde et al. . | |
| 4,356,085 | 10/1982 | Schon et al. . | |
| 4,513,759 | 4/1985 | Wochnowski et al. . | |
| 4,576,108 | 3/1986 | Socola et al. . | |
| 4,639,383 | 1/1987 | Casey . | |
| 4,730,627 | 3/1988 | Burcham, Jr. et al. . | |
| 4,757,830 | 7/1988 | Halliday . | |
| 4,887,619 | 12/1989 | Burcham, Jr. et al. | 131/305 |
| 4,973,167 | 11/1990 | Zmarlicki | 34/135 |

*Primary Examiner*—V. Millin
*Assistant Examiner*—Lynne A. Reichard
*Attorney, Agent, or Firm*—Charles B. Smith; Alan D. Smith

[57] ABSTRACT

An apparatus and method for conditioning tobacco or other similar materials. In the preferred embodiment, a conditioning cylinder 200 comprises a plurality of flights 240, backmixing baffles 260, and ejection baffles 280, all mounted to the interior wall 220 of cylinder 200. Rotation of the cylinder 200 mixes and conveys the material. Spray nozzle assembly 400 is positioned adjacent to the entrance of the cylinder 200 and comprises spray nozzles 410–450. The spray nozzles are aimed at a plurality of predetermined target areas within the cylinder 200 for directing a conditioning spray onto the material in the target areas. Recirculation conduit 500 recirculates air exiting the cylinder 200 and, before reentering the cylinder, combines the recirculated air with ambient air from fresh air make-up ports 520.

13 Claims, 5 Drawing Sheets

CONDITIONING CYLINDER WITH FLIGHTS, BACKMIXING BAFFLES, CONDITIONING NOZZLES AND AIR RECIRCULATION

BACKGROUND OF THE INVENTION

This invention relates to conditioning cylinders, and more particularly to conditioning cylinders having flights, backmixing baffles, gentler conditioning nozzles and air recirculation.

Conditioning cylinders having rows of pins fitted on their inside walls are currently used for blending, steam-conditioning, drying, and applying flavorants to tobacco or other similar materials. The conditioning cylinder is positioned with the entrance end elevated and is rotated about its longitudinal axis. A typical cylinder for conditioning tobacco is about 28 feet long, about 8 feet in diameter, inclined at an angle of about 2½ degrees from horizontal, and rotated at about 13 revolutions per minute. Material to be processed enters the conditioning cylinder at the elevated end and the rotation mixes and conveys the material along the length of the cylinder, eventually discharging the material at the lower end.

Steam-conditioning tobacco involves increasing the moisture content in the tobacco from about 12% to 16.5%. This increase in moisture content is accomplished by spraying the tobacco in the conditioning cylinder with steam and water so that the tobacco absorbs this moisture. The increase in moisture content makes the tobacco leaves more pliable and less susceptible to breakage during subsequent processing operations required to manufacture tobacco cigarettes.

It is desirable to condition the tobacco with minimal material degradation and uniform moisture application.

A developed view of the interior of a conditioning cylinder 100 constructed in accordance with conventional principles and commercially available from Dickinson Corp., Winchester, England, is shown in FIG. 1. Cylinder pins 110 are used to convey and lift the tobacco during rotation of cylinder 100. However, the action of the pins often degrades the tobacco by breaking the tobacco into smaller pieces as it moves through the cylinder.

FIG. 4 shows a steam and water spray nozzle assembly 300 also commercially available from the Dickinson Corp. A closed recirculation duct system (not shown) recirculates air from the exit to the entrance. This design may not uniformly moisturize the tobacco and may raise the temperature of the tobacco to detrimental levels, also degrading the final product.

It will be appreciated from the foregoing, that an apparatus and method which uniformly conditions the material or tobacco, while reducing material degradation and maintaining the material at lower temperatures would be a needed improvement. The present invention fulfills this need.

SUMMARY OF THE INVENTION

The apparatus and method of the invention includes a conditioning cylinder with air recirculation and ambient air makeup.

A configuration of multiple spray nozzles are disposed within the cylinder and aimed to spray steam and water on a material in predetermined target areas within the cylinder. The nozzles are arranged to reduce the pressure and velocity of the conditioning steam and water, thus reducing degradation and improving conditioning.

Air and steam exiting the cylinder is recirculated through a recirculation conduit to reenter the cylinder. The recirculated air and steam is mixed with ambient air. Recirculation improves conditioning. Adding cooler ambient air reduces the temperature in the cylinder and consequently, reduces the temperature of the material, thereby reducing degradation to the material.

The wet material is mixed and conveyed through the cylinder in a downstream direction. A plurality of flights are mounted to the inside of the cylinder, oriented parallel to the longitudinal axis of the cylinder and arranged in staggered rows to make the action of the cylinder more gentle. A plurality of backmixing baffles are mounted to the inside of the cylinder and inclined from the cylinder wall. The backmixing baffles connect the end of one flight with the adjacent downstream flight for causing portions of the downstream flowing material to momentarily flow in an upstream direction, thereby increasing the residence time of the material within the cylinder. Increased residence time also improves the conditioning.

Additional features of the invention, its nature and various advantages will be more apparent from the accompanying drawings and the following detailed description of the invention.

DETAILED DESCRIPTION OF THE PREFERRED EMBODIMENTS

Figure 1:
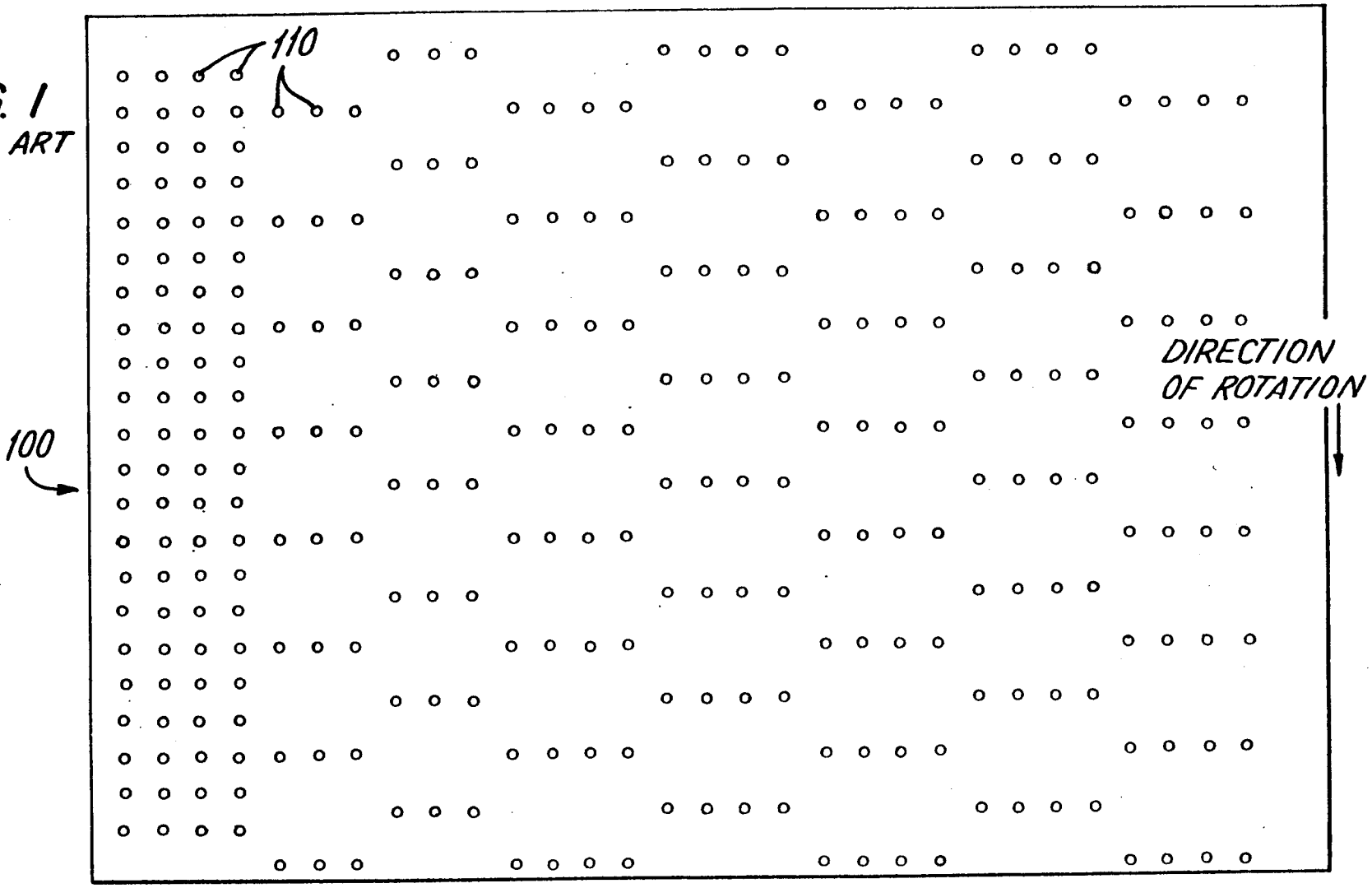
FIG. 1 PRIOR ART
FIG. 1 is a developed diagram of the arrangement of pins in a prior art conditioning cylinder.
Figure 2:
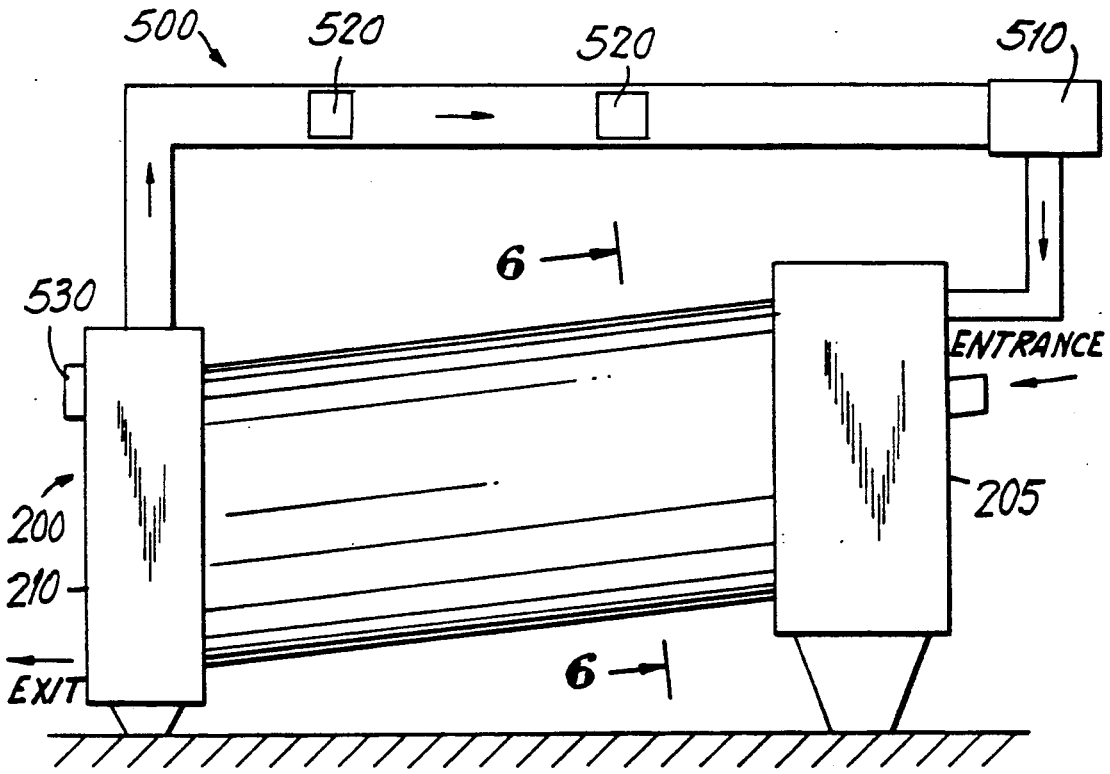
FIG. 2 is an illustrative drawing of a perspective view of the exterior of a conditioning cylinder constructed in accordance with the principles of this invention.

A preferred embodiment of a conditioning cylinder 200 constructed in accordance with the principles of this invention is shown in FIG. 2. Although cylinder 200 may be used for processing any grade or type of tobacco or other similar material, this preferred embodiment is particularly well suited for conditioning "oriental" tobacco. Oriental tobacco typically has a smaller leaf size.

The cylinder 200 is mounted for rotation about its longitudinal axis by any suitable means, e.g., as shown in expired U.S. Pat. No. 3,386,448. As shown in FIG. 2, the entrance end 205 is elevated above the exit end 210 by about 0 to 5 degrees from the horizontal.

Tobacco to be conditioned is delivered by a suitable conveyor or other delivery mechanism (not shown) to the entrance end 205 of the cylinder 200. The conditioning cylinder 200 is rotated about its longitudinal axis at a speed of approximately thirteen rotations per minute, while conditioning steam and water is sprayed on the tobacco by a spray nozzle assembly 400 (shown in FIGS. 5 and 6). The conditioning cylinder is filled with hot steamy air provided by a combination of the spray nozzle assembly 400 and a recirculation air flow conduit 500. Conditioned tobacco exits at the lower end of the cylinder 210 and is deposited on a suitable conveyor (not shown). Tobacco flows downstream from the entrance to the exit.

The goal of conditioning the oriental tobacco is to increase its moisture content from about 12% to 16.5%. This increases the pliability of the tobacco and decreases degradation to the tobacco during subsequent manufacturing processes.

The steam and water inside the cylinder is absorbed by the tobacco, thereby increasing the moisture content of the tobacco. Increased residence time in the cylinder and more steam and water help the conditioning process. Also, increasing the temperature of the tobacco speeds the moisture absorption. However, increasing the temperature too much will negatively affect the conditioning because it causes the tobacco to break and degrade. Therefore, an objective of the present invention is to maximize steam and water in the cylinder, while maintaining the temperature within the cylinder and the temperature of the tobacco within a desirable range.

The present invention increases the conditioning steam and water by utilizing the spray nozzle assembly 400 and recirculating steamy air through recirculation conduit 500. The present invention controls the temperature of the tobacco by mixing room temperature ambient air with the recirculating air. The ambient air reduces the temperature of the recirculating air so that when the recirculating air reenters the cylinder, it reduces the temperature in the cylinder and, consequently, the temperature of the tobacco.

Figure 3:
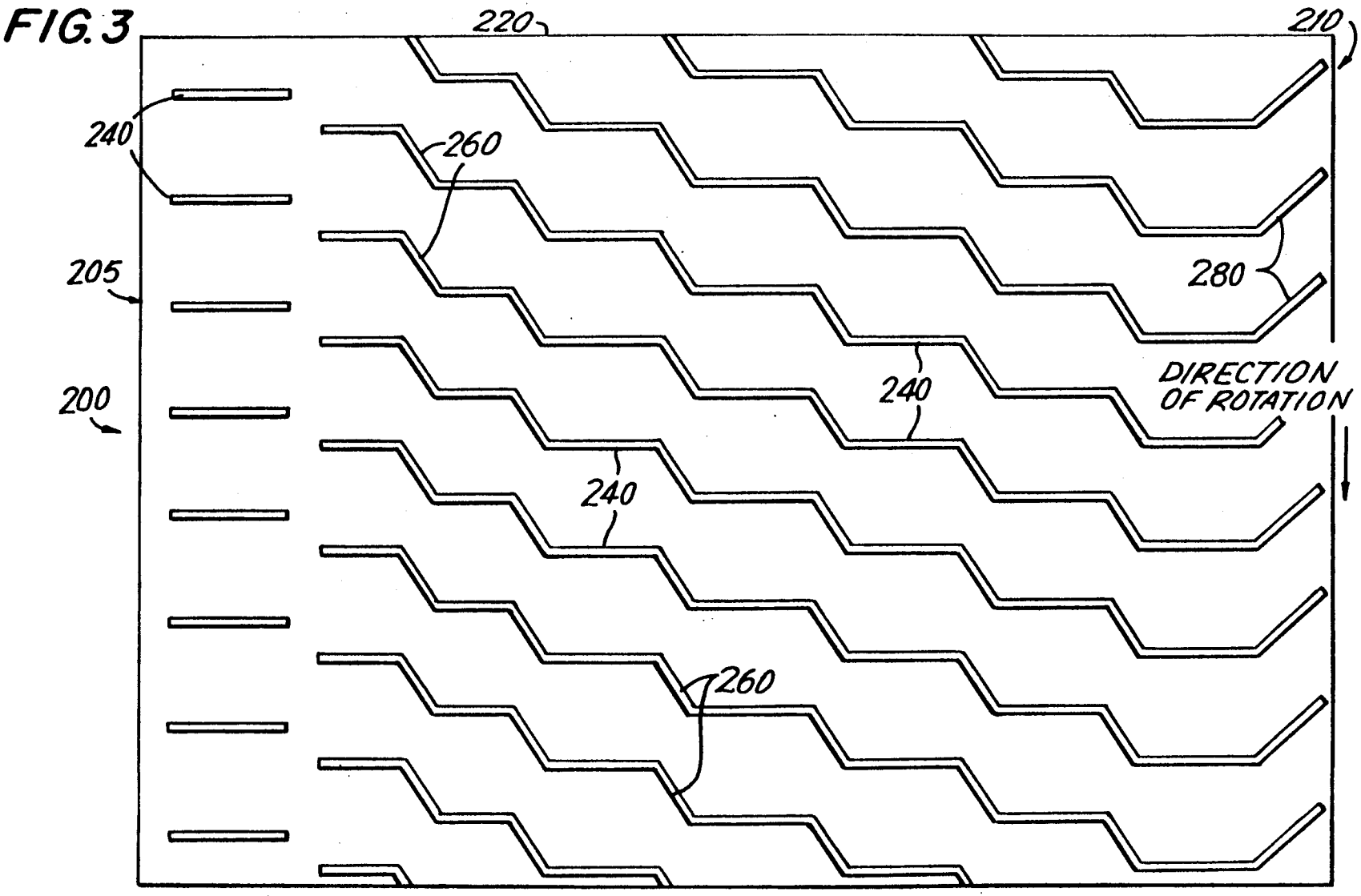
FIG. 3 is a view similar to FIG. 1 showing an illustrative embodiment of a conditioning cylinder constructed in accordance with the principles of this invention.

FIG. 3 shows interior cylinder wall 220, flights 240, backmixing baffles 260, and discharge baffles 280.

Cylinder wall 220 is used to enclose the material being processed, and to provide structural support for flights 240, backmixing baffles 260 and discharge baffles 280. Cylinder wall 220 is constructed of medium- or heavy-gauge sheet metal. The circumference is about 25 feet and the length is about 28 feet. Of course, this invention is not limited to the materials, dimensions and configurations of this described preferred embodiment.

A plurality of flights 240, also constructed of medium- or heavy-gauge sheet metal, are positioned on the interior surface of the cylinder wall 220. In the preferred embodiment, each piece of sheet metal comprising a flight 240 is mounted edgewise to the interior surface 220 and extends radially from the surface towards the longitudinal axis of the cylinder 200.

Although flights 240 may be distributed in any fashion about the circumference and length of cylinder wall 220, in the preferred embodiment, they are parallel to the longitudinal axis of the cylinder wall 220. Circumferentially adjacent flights are preferably equally spaced around the circumference of cylinder wall 220. The flights are arranged in a plurality of longitudinally spaced circumferential bands or rows, with the flights in each row being circumferentially offset from the flights in the adjacent upstream and downstream rows. For example, in FIG. 3, each flight 240 is circumferentially half way between the two adjacent flights in both the upstream and downstream rows. Flights 240 lift and convey the tobacco down the length of the cylinder 200 to the discharge end 210.

A plurality of backmixing baffles 260, also constructed of medium- or heavy-gauge sheet metal, are mounted to the interior surface of the cylinder wall 220. Backmixing baffles 260 are inclined from the inner surface of the cylinder wall 220 towards the entrance of the cylinder 205. The width of the backmixing baffles 260 is equal to the offset between adjacent flights 240 in adjacent rows. A backmixing baffle 260 is connected both to the downstream end of a flight 240 in one row and the upstream end of an adjacent flight 240 in the downstream adjacent row.

The inclination angle of backmixing baffles 260 with respect to the cylinder wall 220 is selected so that backmixing baffles 260 cause portions of the downstream flowing tobacco to momentarily flow in an upstream direction. As the backmixing baffles 260 move with the rotating cylinder 200, their inclined faces tend to intercept the tobacco moving downstream and to push the tobacco upstream against the normal downstream flow. This effectively slows the conveyance of tobacco through the cylinder 200, thereby improving the quality and uniformity of tobacco conditioning by increasing the residence time of the tobacco in the conditioning cylinder 200. Although various angles of backmixing baffle inclination may be used, an inclination angle between about 10° and 20° has been found preferable.

A plurality of discharge baffles 280 are also positioned on the interior surface of the cylinder wall 220. Discharge baffles 280 are constructed of medium- or heavy-gauge sheet metal. They are mounted radially to the inner surface of the cylinder wall 220. Each discharge baffle 280 is connected to the downstream end of a flight 240 in the row closest to the discharge end of the cylinder 210. Discharge baffles 280 are angled opposite the direction of rotation of the cylinder 200 (they are not parallel to the longitudinal axis of the cylinder 200) to push the tobacco out of cylinder 200. This improves the uniformity of discharge.

Figure 4:
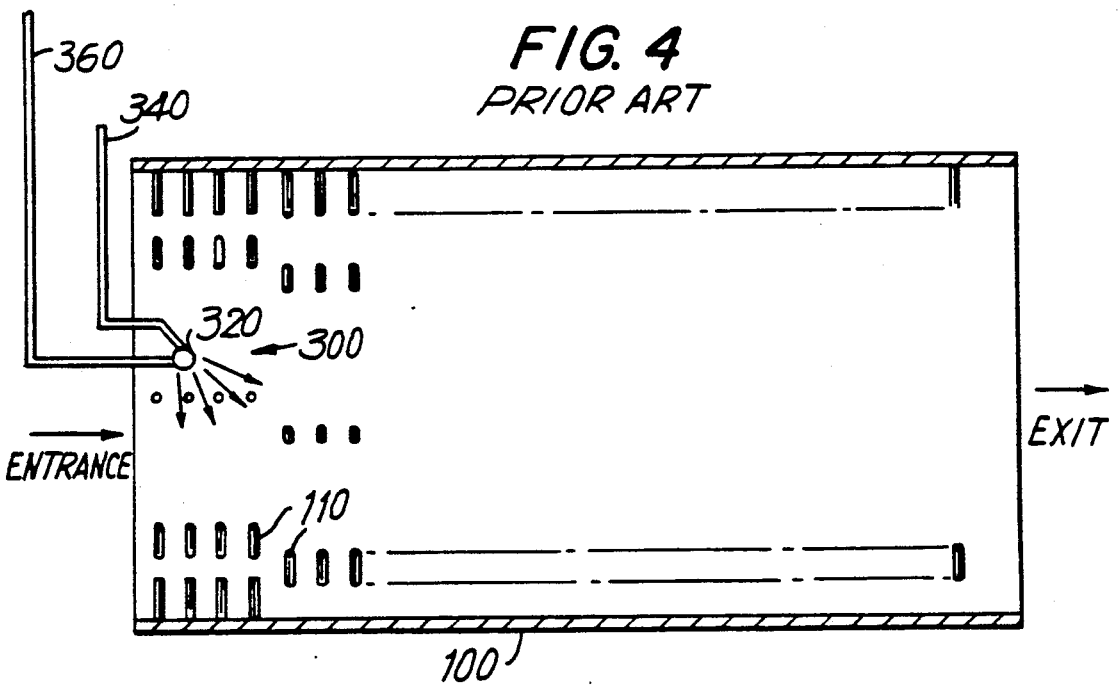
FIG. 4 PRIOR ART
FIG. 4 is a simplified longitudinal sectional view of a prior art conditioning cylinder with a spray nozzle assembly.

In the prior art conditioning cylinder shown in FIG. 4, spray nozzle assembly 300 comprises a single spray nozzle 320 based upon a crushed pipe design (also available from Dickinson Corp.). Steam is supplied via steam conduit 340 and water is supplied via water conduit 360. Steam and water are sprayed by the spray nozzle 320 in the general entrance area of the cylinder 100.

Figure 5:
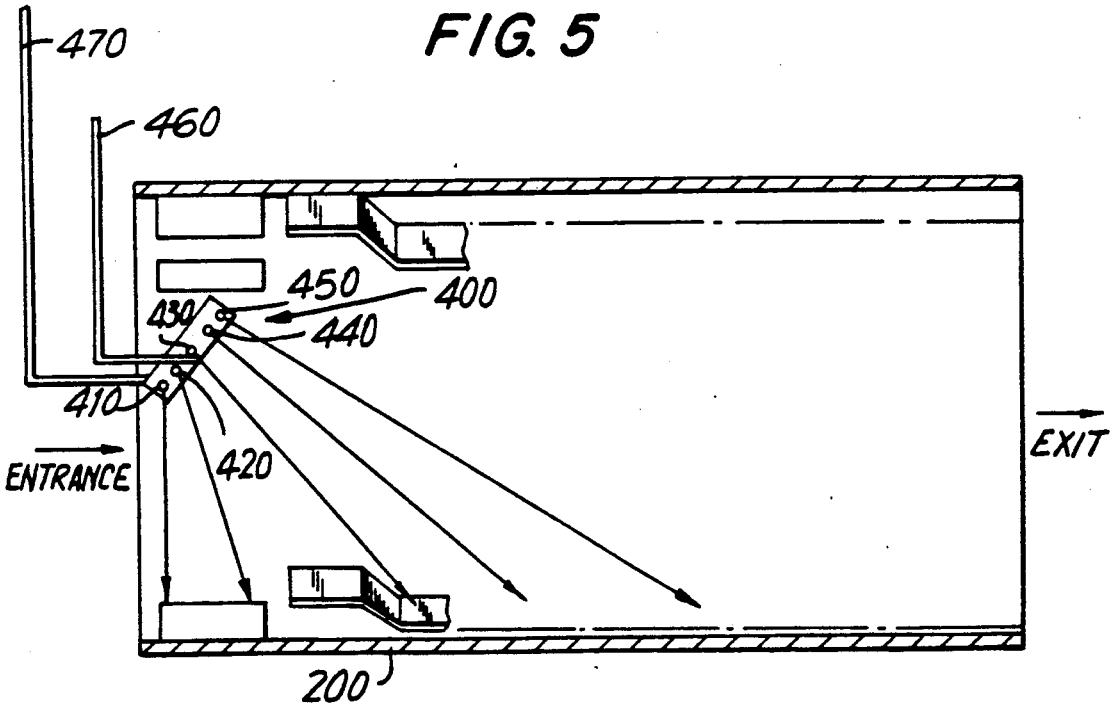
FIG. 5 is a view similar to FIG. 4 showing an illustrative embodiment of a spray nozzle assembly configured according to the principles of this invention.
Figure 6:
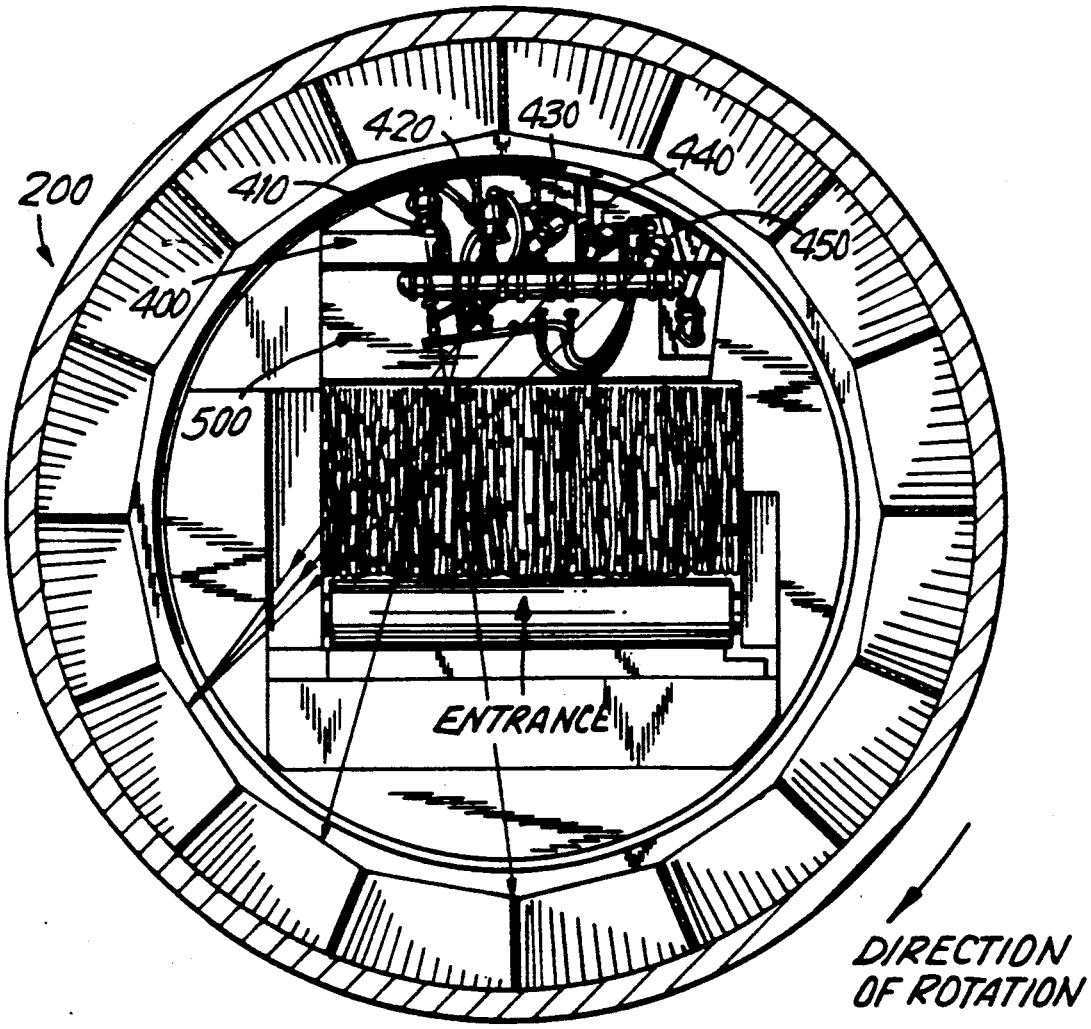
FIG. 6 is a cross-sectional view of the cylinder of FIG. 2 from the discharge end showing the angular target position of each spray nozzle.

A preferred embodiment of a spray nozzle assembly 400 of the present invention is shown in FIG. 5. Spray nozzle assembly 400 comprises five nozzles, numbered 410–450. Steam is supplied via steam conduit 460 and water is supplied via water conduit 470. Steam and water are together sprayed from each nozzle. The steam and water are atomized together. Each nozzle is aimed at a specific predetermined target area within the conditioning cylinder 200. The present preferred angular target positions of each spray nozzle 410–450, are shown in FIGS. 5 and 6. The view of FIG. 6 is a cross-section view of FIG. 2 looking at the conditioning cylinder 200 from the discharge end. Of course, this invention contemplates a broad range of target positions.

The spray nozzle assembly 400 advantageously provides more steam and water, while utilizing lower atomization velocities. The spray impacts the tobacco with less velocity and thus, reduces degradation. By aiming the nozzles at a plurality of specific target areas, the spray more thoroughly and uniformly conditions the tobacco.

Spray nozzle 410 (target position approximately 6 inches from the upstream end of the cylinder 100 and at the 6 o'clock position) sprays the dry tobacco as soon as it enters the conditioning cylinder 200. This quick introduction of steam and water prevents dehydration.

Spray nozzle 420 (target position approximately 20 inches from the upstream end of the cylinder 200 and at the 7 o'clock position) sprays the tobacco slightly farther inside the cylinder 200. There is some overlap with nozzle 410. At this point, the tobacco begins to retain heat and moisture provided by the steam and water.

Spray nozzle 430 (target position approximately 5 feet from the upstream end of the cylinder 200 and at the 8 o'clock position) sprays the tobacco as it moves into the interior of the cylinder 200. The desired moisture level (about 16.5% OV) and temperature level (about 105 degrees to about 120 degrees Fahrenheit) are achieved at this point.

Spray nozzle 440 (target position approximately 10 feet from the upstream end of the cylinder 200 and at the 8 o'clock position) and spray nozzle 450 (target position approximately 14 feet from the upstream end of the cylinder 200 and at the 8 o'clock position) maintain this moisture and temperature level of the tobacco throughout the remaining downstream portion of the cylinder 200. This provides for penetration of the moisture and heat into the leaf, and prevents premature flashing off of the moisture.

The recirculation air flow conduit 500, shown in FIG. 2, connects the exit side of the cylinder 210 to the entrance side of the cylinder 205 for recirculating air from the exit to the entrance. Air recirculation contributes to the steamy, humid condition in the cylinder, thereby aiding the conditioning. Air is pumped into the entrance of the cylinder 205 and through the cylinder 200 by a recirculation pump or fan 510. Air exiting the cylinder 200 is recirculated through the recirculation conduit 500 and again pumped through the cylinder 200.

The preferred embodiment advantageously mixes ambient air, received through fresh air makeup ports 520, with the recirculated air to control the temperature of the recirculated air. The ambient air cools the hot steamy recirculating air. This cooler recirculated air is still laden with moisture, but acts to reduce the temperature in the cylinder and, consequently, the temperature of the tobacco. Without adding ambient air, the temperature of the tobacco for the same amount of steam and water would be higher and would degrade the tobacco. Depending on the condition of the tobacco (e.g., its moisture level) and the ambient air (e.g., its temperature and humidity), the proportion of ambient air will be in the range of 30–70%. Of course, this invention also includes smaller and larger proportions.

The presently preferred embodiment contemplates 50% recirculated air mixed with 50% ambient air. The temperature at the exit end of the cylinder is in the range of 120°–130°. The addition of ambient air cools the recirculated air so that the recirculated air reenters the cylinder at approximately 106°.

Exhaust doors 530 are also provided to vent some of the air exiting the cylinder, instead of this air being recirculated. The exhaust doors 530 release excess heat and help control the ratio of recirculated air to ambient air. This ultimately reduces tobacco degradation. Screens (not shown) are also provided at the exit of the cylinder. They are disposed to catch tobacco in the air before it exits through the exhaust doors 530 or enters the recirculating conduit 500.

The speed of recirculation fan 510 may be adjusted to control the temperature in the cylinder. The amount of air exiting through the exhaust doors 530 may also be adjusted to control the temperature in the cylinder.

It will be understood that the foregoing is merely illustrative of the principles of the invention, and that various modifications can be made by those skilled in the art without departing from the scope and spirit of the invention. This invention is only limited by the claims.

The invention claimed is:

1. A conditioning apparatus for increasing the moisture content of a particulate material adapted to receive moisture on its surface and to absorb moisture from its surface, comprising:

a hollow generally cylindrical housing having an entrance for receiving said material and an exit for discharging said material;

rotating means for rotating said housing about its central longitudinal axis;

conveyor means disposed within said housing for mixing said material while being conveyed in a downstream direction through said rotating housing from said entrance to said exit, including backmixing baffles mounted to the interior wall of said housing and inclined from said interior wall for causing portions of said downstream flowing material to momentarily flow in an upstream direction, thereby increasing the residence time of said material within said housing;

spray means disposed within said housing for directing a conditioning spray onto said material in a plurality of target areas within said housing; and recirculation means for increasing the moisture content of said material having a recirculation conduit coupling said exit of said housing to said entrance, pump means for recirculating air into said housing by pumping air exiting said housing through said conduit, and ambient air means for mixing ambient air with said recirculating air in said conduit.

2. The apparatus of claim 1, wherein said particulate material is tobacco material.

3. The apparatus of claim 2 wherein:

said housing is an inclined hollow cylinder with said entrance end being elevated; and said conveyor means further includes a plurality of flights radially mounted to said interior wall of said housing for mixing said material.

4. The apparatus of claim 3, wherein said conveyor means further includes a plurality of ejection baffles mounted to said interior wall of said housing and mounted adjacent to said housing exit for ejecting said material from said housing.

5. The apparatus of claim 3, wherein said flights are disposed in a plurality of longitudinally spaced circumferential rows, with said flights in a row being circumferentially offset from said flights in adjacent rows, and with said backmixing baffles connecting a flight in one row with an adjacent offset flight in an adjacent row.

6. The apparatus of claim 2, wherein said spray means includes a plurality of spray nozzles disposed within said housing and each said nozzle is aimed at a predetermined target area within said housing.

7. The apparatus of claim 6, wherein said plurality of spray nozzles are disposed at said entrance end of said housing.

8. The apparatus of claim 2, wherein said recirculation means further includes exhaust means for venting a portion of the air exiting said housing so that said portion is not recirculated through said conduit.

9. An apparatus for conditioning tobacco material comprising:

a hollow cylinder housing having an entrance for receiving said material and an exit for discharging said material, wherein said housing is inclined from the horizontal with said entrance end being elevated;

rotating means for rotating said housing about its central longitudinal axis;

conveyor means disposed within said housing for conveying said material in a downstream direction through said rotating housing from said entrance to said exit;

said conveyor means including a plurality of flights radially mounted to said interior wall of said housing for mixing said material while being conveyed to said discharge exit, wherein said flights are disposed in a plurality of longitudinally spaced circumferential rows, with said flights in a row being circumferentially offset from said flights in adjacent rows;

said conveyor means including a plurality of backmixing baffles mounted to said interior wall of said housing, inclined from said interior wall, and connecting a flight in one row with an adjacent offset flight in an adjacent row, wherein said baffles cause portions of said downstream flowing material to momentarily flow in an upstream direction, thereby increasing the residence time of said material within said housing;

a plurality of spray nozzles disposed within said housing, where each said nozzle is aimed at a predetermined target area within said housing for directing a conditioning spray onto said material in said predetermined target areas; and recirculation means having a recirculation conduit coupling said exit of said housing to said entrance, pump means for recirculating air into said housing by pumping air exiting said housing through said conduit, ambient air means for mixing ambient air with said recirculating air in said conduit, and exhaust means for venting a portion of the air exiting said housing so that said portion is not recirculated through said conduit.

10. A conditioning method for increasing the moisture content of tobacco material comprising the steps of:

rotating a hollow generally cylindrical housing about its central longitudinal axis;

receiving said material into said housing through an entrance disposed in said housing;

mixing said received material while said material is being conveyed through said rotating housing in a downstream direction, wherein a plurality of flights radially mounted to the interior wall of said housing and a plurality of backmixing baffles mounted to the interior wall of said housing mix said material, and wherein said baffles are inclined from said interior wall for causing portions of said downstream flowing material to momentarily flow in an upstream direction, thereby increasing the residence time of said material within said housing;

spraying said material with a conditioning spray in predetermined target areas by directing a plurality of spray nozzles disposed within said housing at said predetermined target areas;

recirculating air into said housing for increasing the moisture content of said material by pumping air exiting said housing through a recirculation conduit coupling said exit of said housing to said entrance;

mixing ambient air with said recirculating air; and discharging said material from an exit in said housing.

11. The method of claim 10 wherein said method further comprises the step of: venting a portion of the air exiting said housing so that said portion is not recirculated through said conduit.

12. The method of claim 10, wherein said plurality of spray nozzles are disposed at said entrance end of said housing.

13. An apparatus for conditioning tobacco material comprising:

an inclined hollow cylinder housing having an entrance for receiving said material and an exit for discharging said material, with said entrance end being elevated;

rotating means for rotating said housing about its central longitudinal axis;

conveyor means disposed within said housing for mixing said material while being conveyed in a downstream direction through said rotating housing from said entrance to said exit, including backmixing baffles mounted to the interior wall of said housing and inclined from said interior wall for causing portions of said downstream flowing material to momentarily flow in a upstream direction, thereby increasing the residence time of said material within said housing;

said conveyor means further including a plurality of flights radially mounted to said interior wall of said housing for mixing said material and said flights disposed in a plurality of longitudinally spaced circumferential rows, with said flights in a row being circumferentially offset from said flights in adjacent rows, and with said backmixing baffles connecting a flight in one row with an adjacent offset flight in an adjacent row;

spray means disposed within said housing for directing a conditioning spray onto said material in a plurality of target areas within said housing; and recirculation means having a recirculation conduit coupling said exit of said housing to said entrance, pump means for recirculating air into said housing by pumping air exiting said housing through said conduit, and ambient air means for mixing ambient air with said recirculating air in said conduit.

* * * * *